United States Patent [19]

Shoffner

[11] Patent Number: 4,832,421

[45] Date of Patent: May 23, 1989

[54] READY-TO-ASSEMBLE CABINET

[76] Inventor: Donald I. Shoffner, 3026 Conner Dr., Knoxville, Tenn. 37928

[21] Appl. No.: 186,582

[22] Filed: Apr. 27, 1988

[51] Int. Cl.[4] ..... A47B 43/00

[52] U.S. Cl. ..... 312/263; 312/264; 312/257 R

[58] Field of Search ..... 312/257 R, 257 SM, 263, 312/138 R, 264; 49/413; 211/189, 186; 108/111

[56] References Cited

U.S. PATENT DOCUMENTS

| | | | |
|---|---|---|---|
| 1,833,081 | 11/1931 | Kilmer | 312/257 R |
| 2,279,864 | 4/1942 | Eide | 211/189 |
| 3,069,216 | 12/1962 | Vaeth | 312/257 R |
| 3,419,933 | 1/1969 | Gossen | 312/138 R |
| 3,601,462 | 8/1971 | Fenwick | 312/138 R |
| 3,612,289 | 10/1971 | Zink | 108/111 |
| 4,014,270 | 3/1977 | King | 108/111 |
| 4,153,311 | 5/1979 | Takahashi | 312/257 R |
| 4,562,776 | 1/1986 | Miranda | 108/111 |
| 4,582,002 | 4/1986 | Wright | 211/189 X |
| 4,596,195 | 6/1986 | Wenger | 211/204 |

*Primary Examiner*—Joseph Falk

*Attorney, Agent, or Firm*—Nies, Webner, Kurz & Bergert

[57] ABSTRACT

A ready-to-assemble cabinet requiring no fasteners for assembly. Side panels interlock with a back panel, front rail, and shelves to form a free-standing, self-supporting unit.

8 Claims, 3 Drawing Sheets

READY-TO-ASSEMBLE CABINET

BACKGROUND OF THE INVENTION

This invention relates generally to furniture of the type which requires no tools or hardware for assembly as exemplified by U.S. Pat. Nos. 3,069,216 and 4,153,311. More particularly, the invention pertains to a novel, ready-to-assemble cabinet formed by parts which interlock in unique structural fashion, the cabinet being readily adaptable to various designs and uses while retaining its basic interlocking structural features.

SUMMARY AND OBJECTS OF THE INVENTION

Accordingly, the primary object of this invention is to provide a novel, ready-to-assemble cabinet which is quick and easy to assemble requiring no fasteners, sturdy and rigid permitting normal usage, and aesthetically pleasing in appearance.

Another object is to provide the above novel, ready-to-assemble cabinet constructed from interlocking parts to form a stable, free-standing, self-supporting unit.

A further object is to provide the above novel ready-to-assemble cabinet including vertical side panels and a back panel which quickly and uniquely interlock together to form an upright unit.

Still another object is to provide the above novel cabinet formed by side panels which are grooved out and slotted in novel fashion to interlock with mating top, bottom, front, and back panels.

A further object is to provide the above cabinet including a novel, molded plastic door track assembly which snaps on the front panel for easy mounting and provides upper door glides for a pair of slidable doors.

Still other objects and advantages of the invention will become apparent upon reading the following detailed description of the invention with reference to the accompanying drawings wherein like numerals denote like elements.

DETAILED DESCRIPTION OF THE INVENTION

Figure 1:
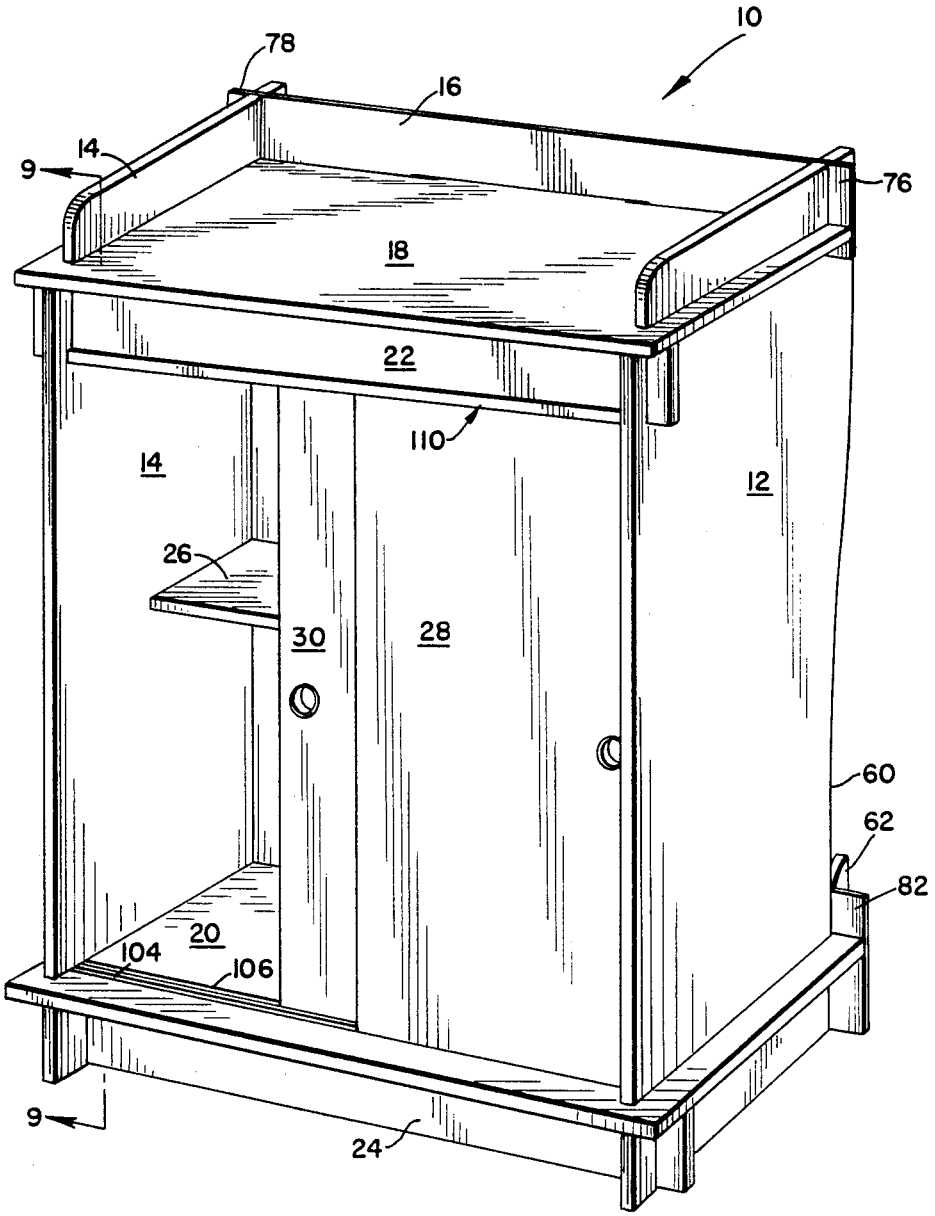
FIG. 1 is a perspective view of one embodiment of the novel cabinet of the invention in its free-standing, self-supporting, assembled form.

Referring now to the drawings, cabinet 10 of the invention comprises vertical right and left side panels 12 and 14, vertical back panel 16, horizontal top shelf panel 18, horizontal bottom shelf panel 20, vertical upper front rail 22, and vertical lower front rail 24, all of which suitably interlock together with no fasteners required as will be described hereinafter to form a free-standing, self-supporting unit such as that shown in FIG. 1. An inner horizontal shelf 26 is mounted between side panels 12 and 14 and front doors 28 and 30 are slidably secured between rail 22 and bottom panel 20. All the parts may be constructed of rigid material, such as one-half inch plywood, press board, or laminated board.

Figure 2:
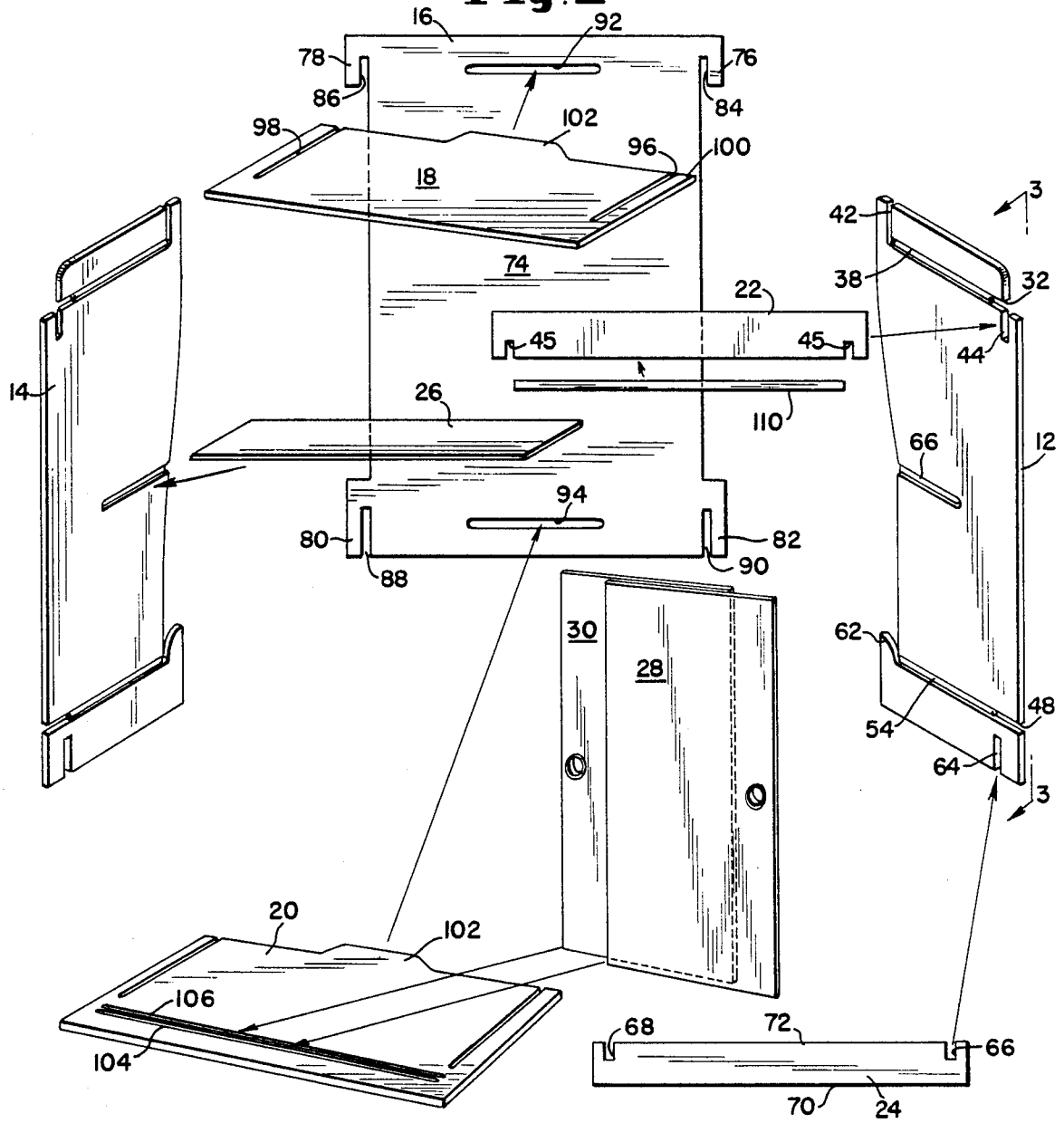
FIG. 2 is an exploded perspective view of the cabinet, illustrating the various parts as they would interlock together to form the cabinet of FIG. 1.
Figure 3:
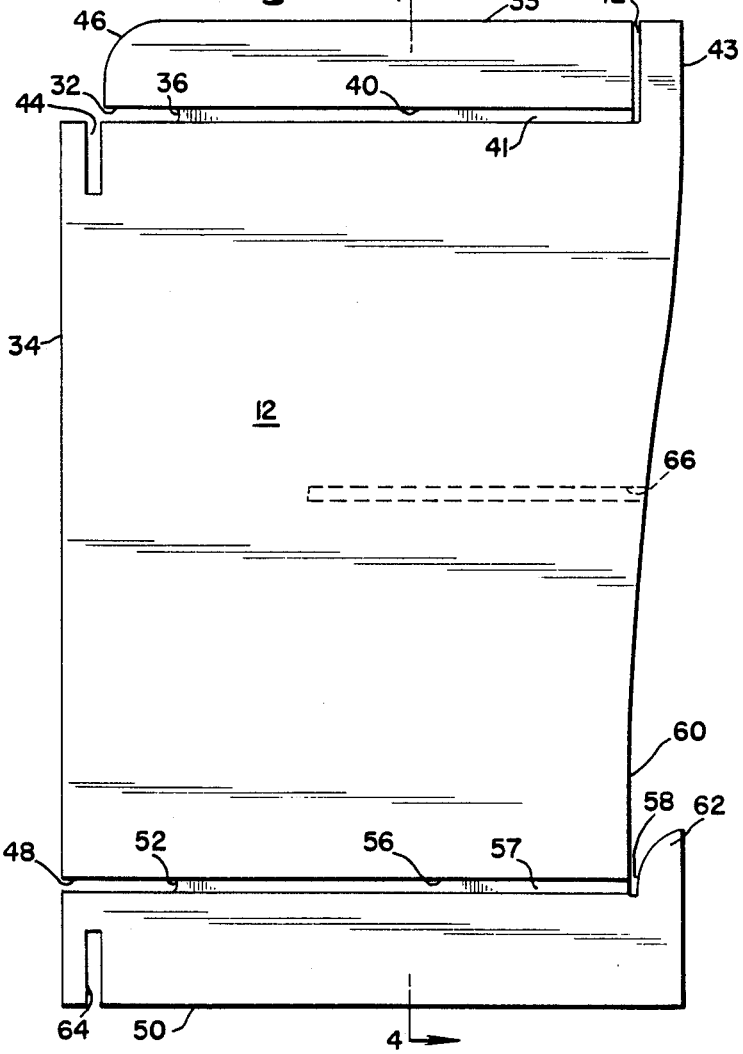
FIG. 3 is a side view of the right side panel taken generally along line 3—3 of FIG. 2.
Figure 4:
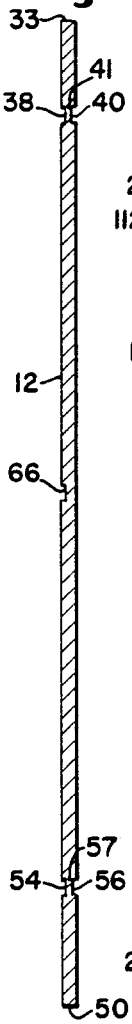
FIG. 4 is a sectional view taken along line 4—4 of FIG. 3 generally illustrating the shelf-supporting horizontal grooves formed in the side panels.

Side panels 12 and 14 are identical in construction, except that the grooves for supporting shelf 26 are located on the inside face of each panel. As shown in FIGS. 2–4, panel 12 has an upper horizontal slot 32 located below its top edge 33 and extending from its front edge 34 to a point 36 where it joins inside and outside grooves 38 and 40 cut on opposite sides of solid center section 41, the grooves continuing to the rear to intersect an upper vertical slot 42 extending downwardly from top edge 33 and spaced inwardly from back edge 43. A vertical slot 44 extends perpendicularly downwardly from slot 32, and the curved forward portion 46 of upper edge 33 terminates at a point slightly behind slot 44. This permits rail 22 to be interlocked with side panels 12 and 14 by inserting slots 45 into slots 44, the slots being sized so that the top of rail 22 is flush with the bottom edge of slots 32.

Panel 12 also has a lower horizontal slot 48 spaced above bottom edge 50 and extending parallel to slot 32 to a point 52 where it joins inside and outside grooves 54 and 56 cut on opposite sides of solid center section 57, the grooves continuing to the rear to intersect a lower vertical slot 58 formed between the face of an inwardly curved portion 60 of back edge 43 and ear 62 extending upwardly from bottom edge 50. Point 52 is in vertical alignment with point 36 and slot 58 is in vertical alignment with slot 42. A vertical slot 64 extends upwardly from bottom edge 50 to receive lower rail 24.

Each panel 12 and 14 has a horizontal groove 66 extending from its back edge partially along its inside face to receive and support the side edges of inner shelf 26, which has a depth less than the depth of the side panels.

Bottom rail 24 has vertical slots 66 and 68 which interlock with slots 64 in side panels 12 and 14. When assembled, its bottom edge 70 lies flush on the floor with bottom edges 50, and its upper edge 72 is flush with the bottom of slot 48.

Back panel 16 (FIGS. 1, 2, 7 & 8) includes a main rectangular section 74 and laterally projecting corner ears 76, 78, 80, and 82 which, together with the edges of section 74, define downwardly opening vertical slots 84, 86, 88, and 90 that interlock with slots 42 and 58 to lock side panels 12 and 14 and back panel 16 together. Upper and lower horizontal slots 92 and 94 are provided in section 74 in alignment with slots 32 and 48.

Figure 5:
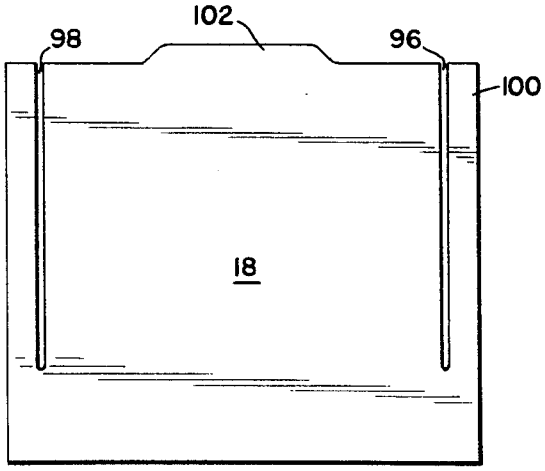
FIG. 5 is a plan view of the upper shelf panel.
Figure 6:
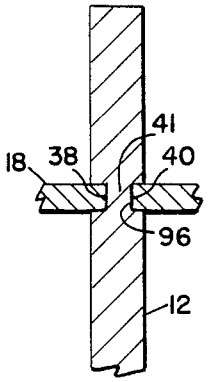
FIG. 6 is a fragmentary sectional view taken in the same direction as FIG. 4 and illustrating the manner in which the slots in a shelf interlock with the grooves in the side panels.

As shown in FIGS. 1, 2, and 5, top shelf panel 18 has a depth somewhat greater than the depth of the side panels and includes horizontal slots 96 and 98 cut forwardly from its back edge 100 and a rearwardly projecting tab 102. As seen in FIG. 6, slots 96 and 98 have a width slightly greater than center section 41 so that the cut edges of the shelf defining the slots are slidably supported within grooves 38 and 40. Tab 102 fits within slot 92.

Figure 9:
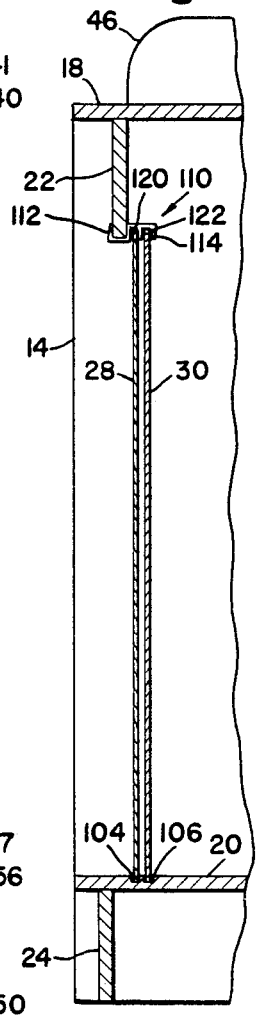
FIG. 9 is a fragmentary sectional view taken generally along line 9—9 of FIG. 1 illustrating the door mounting and track assembly on the front of the cabinet.

Bottom shelf 20 is identical to shelf 18, except that it further includes transverse grooves 104 and 106 which serve as bottom tracks for sliding doors 28 and 30 (FIGS. 2 & 9).

Figure 10:
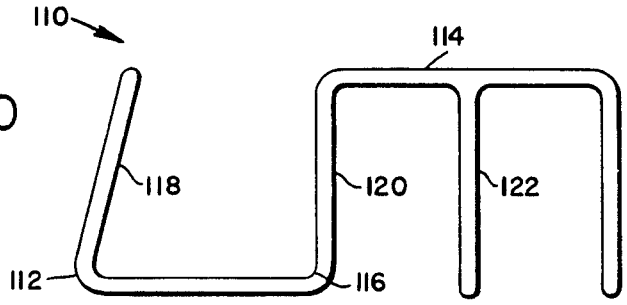
FIG. 10 is a cross sectional view of the molded plastic door track assembly showing the snap-on groove which attaches to the front panel in its relaxed condition.

An upper door track assembly 110 (FIGS. 9 & 10) is a plastic extrusion molding formed by fusing two separate molded pieces 112 and 114 together side-by-side at area 116, with section 112 providing an upwardly opening, spring-like, snap-on channel 118 which in the relaxed condition of FIG. 10 has a width at its top opening less than the thickness of rail 22 so that it snaps on and frictionally engages on the bottom of rail 22. Section 114 provides downwardly opening channels or tracks 120 and 122 in which the upper edges of doors 28 and 30 slide. Tracks 120 and 122 are sufficiently deep to permit insertion of doors 38 and 30 into place.

Figure 7:
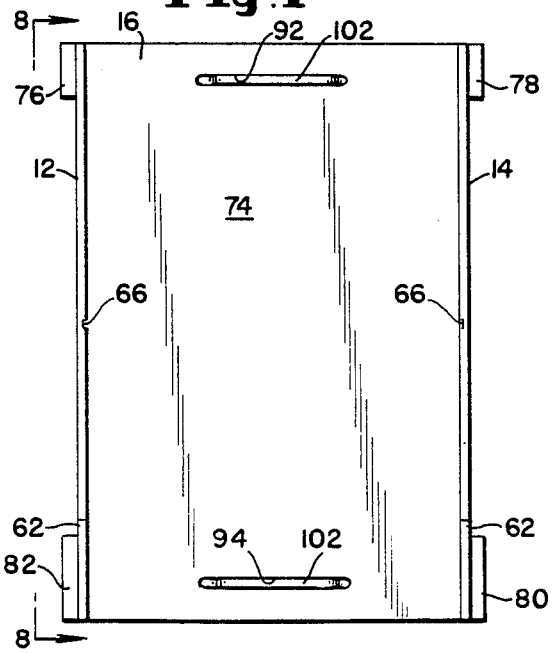
FIG. 7 is a fragmentary rear elevation view illustrating the manner in which the back and side panels interlock together.
Figure 8:
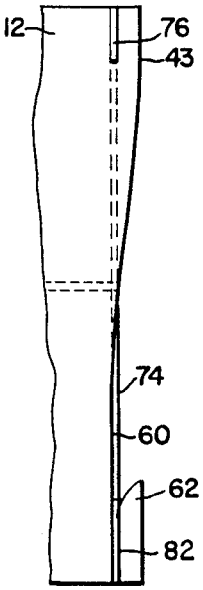
FIG. 8 is a fragmentary view taken along line 8—8 of FIG. 7.

The respective parts of cabinet 10 are individually manufactured and shipped in compact, knockdown, ready-to-assemble fashion on either a skid or in a carton, depending on the need of a customer. To assemble cabinet 10, slots 64 of side panels 12 and 14 are first slid down into slots 66 and 68 of bottom rail 24. Back panel 16 is then interlocked with the side panels by sliding slots 84 and 86 down into slots 42 and slots 88 and 90 into slots 58. As seen in FIGS. 3, 7, and 8, the inwardly curved portion 60 of back edge 43 of side panels 12 and 14 provides clearance for the bottom of panel 16 and enables slots 88 and 90 to be aligned and interlocked with slots 58. Better section 74 of back panel 16 snugly fits between the inside faces of side panels 12 and 14, while ears 76, 78, 80, and 82 overlap and lock against the outside faces of the side panels.

Shelf 26 is then snapped into grooves 66, and upper front rail 22 is dropped into place by sliding slots 45 down into slots 44. Top and bottom shelves 18 and 20 are then slid into place with slots 96 and 98 engaging within grooves 38, 40, and 54, 56 (FIG. 6) and tabs 102 fitting within slots 92 and 94 (FIG. 7). Section 112 of upper door track assembly 110 is then snapped in place on the bottom edge of rail 22, and sliding doors 28 and 30 then fitted within tracks 104, 106 and 120, 122.

The cabinet, assembled by one person in only a few minutes, is free-standing and self-supporting, and requires no separate fasteners. Because side panels 12 and 14 interlock in close tolerances with back panel 16 and front rails 22 and 24, the cabinet is very stable and sturdy and can withstand normal usage. The manner in which shelves 18 and 20 slidably interlock within grooves 38, 40, 54, and 56 helps stabilize the unit, and provides sufficient support for the shelves so that they may bear substantial weight.

As mentioned initially, a cabinet constructed according to the invention is adaptable to various designs and uses. For example, the embodiment shown in FIG. 1 may be used in homes, offices, or commercial establishments as a general utility cabinet for storing and serving such items as coffee, soft drinks, and related condiments, cups, etc. Other designs incorporating the same novel interlocking structural features may be used as a desk, a storage cabinet for computer equipment, or audio and video equipment. Also, if desired, casters may be mounted on the bottom of the side panels to facilitate movement of the cabinet.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An article of furniture comprising first and second vertical side panel means each having a front edge, a back edge, a top edge, and a bottom edge, upper and lower vertical slot means located adjacent said back edge, said upper vertical slot means extending downwardly from said top edge, said back edge having an inwardly projecting portion terminating forwardly of said lower vertical slot means, said upper and lower vertical slot means opening upwardly and being substantially vertically aligned; back panel means having a generally rectangular section fitting between said first and second side panel means and a plurality of ears projecting laterally from said rectangular section and defining a plurality of vertical slots therewith which open downwardly and which interlock with said upper and lower vertical slot means to lock said side panel means and said back panel means together; horizontal shelf means having a pair of laterally spaced slots extending forwardly from its back edge, each of said side panel means having shelf support means including horizontal slot means extending inwardly from its front edge and groove means continuing from said horizontal slot means toward its back edge, the slots of said shelf means being slidably interlocked and supported within said groove means to enable said shelf means to bear substantial weight; each of said side panel means having front vertical slot means adjacent its front edge, and vertical rail means fitting within said front vertical slot means to hold said side panel means together.

2. The article of furniture of claim 1, said front vertical slot means being positioned adjacent said horizontal slot means so that said rail means provides support underneath said horizontal shelf means.

3. The article of furniture of claim 1, said shelf means comprising vertically spaced upper and lower shelves and said side panel members including upper and lower of said shelf support means for supporting said shelves.

4. The article of furniture of claim 3, each of said side panel members having upper front vertical slot means located adjacent its front edge and the horizontal slot means of said upper shelf support means, and said vertical rail means fitting within said upper front vertical slot means to hold said side panel members together and provide support underneath said upper shelf.

5. The article of furniture of claim 4, each of said side panel members having lower front vertical slot means located adjacent its front edge and the horizontal slot means of said lower shelf support means, and second vertical rail means fitting within said lower front vertical slot means to hold said side panel members together and provide support underneath said lower shelf.

6. The article of furniture of claim 5, said back panel having upper and lower horizontal slots, each of said upper and lower shelves having a rearwardly projecting tab fitting into said upper and lower horizontal slots, respectively, and providing support for said shelves.

7. The article of furniture of claim 4 further comprising sliding door means, lower track means formed in said lower shelf to slidably support the bottom of said door means, a molded plastic upper track assembly including first upwardly opening snap-on channel means frictionally engaged on the bottom of said vertical rail means and second downwardly opening channel means for slidably supporting the top of said door means.

8. The article of furniture of claim 4, each of said side panel members having second groove means on its inside face extending forwardly from its back edge, and an inner shelf having side edges mounted within said second groove means.

* * * * *